US007191902B1

(12) United States Patent
Nelson et al.

(10) Patent No.: US 7,191,902 B1
(45) Date of Patent: Mar. 20, 2007

(54) PIZZA BOX LID SUPPORT AND SERVING AID

(76) Inventors: David C. Nelson, 2727 N. Rever Rd., Akron, OH (US) 44333; John J. Andrisin, 613 Center Ave., Cuyahoga Falls, OH (US) 44221

( * ) Notice: Subject to any disclaimer, the term of this patent is extended or adjusted under 35 U.S.C. 154(b) by 209 days.

(21) Appl. No.: 10/697,931

(22) Filed: Oct. 31, 2003

(51) Int. Cl.
*A45C 11/20* (2006.01)

(52) U.S. Cl. ..... 206/551; 30/136; 30/142

(58) Field of Classification Search ..... 206/525, 206/542, 551; 30/114, 123, 136, 142, 165, 30/166.3; 229/116.1, 906; 426/115, 120, 426/128

See application file for complete search history.

(56) References Cited

U.S. PATENT DOCUMENTS

D28,186 S * 1/1898 Barden ..... 30/353
1,612,367 A * 12/1926 Fulton ..... 294/7
3,877,143 A * 4/1975 Montesi ..... 30/114
4,877,609 A * 10/1989 Beck et al. ..... 206/551
5,480,031 A * 1/1996 Maultasch et al. ..... 206/551
5,509,601 A * 4/1996 Drabick ..... 229/906
5,516,036 A * 5/1996 Maultasch et al. ..... 426/115
5,600,889 A * 2/1997 Marotta ..... 30/142
5,774,990 A * 7/1998 McGrey et al. ..... 30/114
5,778,800 A * 7/1998 Liang ..... 108/50.11
6,694,619 B1 * 2/2004 Steck et al. ..... 30/142
6,932,267 B2 * 8/2005 Potenza et al. ..... 229/906

FOREIGN PATENT DOCUMENTS

JP 02000037250 A * 2/2000

* cited by examiner

*Primary Examiner*—Luan K. Bui
(74) *Attorney, Agent, or Firm*—Renner, Kenner, Greive, Bobak, Taylor & Weber

(57) ABSTRACT

A lid support including a support platform and support legs extending downwardly from the support platform is configured such that a plurality of lid supports may be intimately stacked for efficient storage. A serrated leg may be provided extending downwardly and outwardly from the support platform, and particularly preferred modes of practicing the invention include providing a hole in the support platform in order to allow the support platform to be employed as a handle for the serrated leg, by inserting a finger through the hole. The hole also serves to reduce the overall material costs of the lid support.

4 Claims, 6 Drawing Sheets

PIZZA BOX LID SUPPORT AND SERVING AID

BACKGROUND OF THE INVENTION

The present invention generally relates to a support for the lid of a box, and, more particularly, relates to a lid support for a pizza box. The lid support also beneficially functions as a serving aid, and, in preferred embodiments, is able to be stacked for efficient storage and transportation.

When food items are stored in boxes with substantially planar lids that cover a large surface area, the middle portion of the lid may sag and come into contact with the food. This is especially true when multiple boxes are stacked on top of each other, for instance, for delivery. This problem is perhaps most common with take-out and delivery pizzas, which are nearly always served in shallow, long, wide boxes.

To deal with this problem, stool-like lid supports are positioned so that a support platform is elevated over the center of the pizza to prevent the lid from sagging and coming into contact with the pizza. These lid supports, which typically include a support platform maintained in a substantially horizontal position by three downwardly extending legs, are useful for their intended function, but the present invention improves upon them in many ways.

Take-out and delivery pizzas are usually cut before they are placed in pizza boxes. During the time it takes for the pizza to be picked up or delivered, the cheese topping on the pizza will often melt back together over the cut lines between the pizza slices. When a sliced pizza has sat in a pizza box for a short amount of time, one may find that the cheese topping on adjacent slices of pizza has formed one mass of cheese that may fall off of a slice as it is being transferred to a plate. It is therefore advisable to draw a pizza cutter or knife across the initial cut lines, before attempting to serve the pizza, and it would be beneficial if a cutting utensil was provided with a pizza support.

Additionally, it has been found that the common lid support is formed from more material than is necessary to support the lid of a pizza box, and lid supports can be improved by reducing the amount of material from which they are formed. Finally, the common lid supports of the prior art have non-stackable configurations, such that an undue amount of space is needed to ship and store the lid supports, and there is no known practical dispenser for the lid supports. Thus, there is also a need for a stackable lid support, preferably of a configuration that also lends itself to being removably retained in a lid support dispenser.

SUMMARY OF INVENTION

In light of the foregoing, it is an object of the present invention to provide a lid support that makes efficient use of materials.

It is another object of the present invention to provide a lid support that is stackable, for efficient shipping and storage. It is a related object of the present invention to provide a lid support dispenser that functions in conjunction with the fact that the lid supports are stackable.

It is yet another object of the present invention to provide a lid support that provides a cutting utensil for reinforcing the cut lines of a pre-cut pizza.

Herein, the lid support of this invention is disclosed with reference to its employment as a pizza box lid support. However, this invention is not limited to such a use. Other food items that are packaged, transported or delivered in similar boxes may benefit from the use of the lid supports disclosed herein.

In general, the present invention provides a lid support including a support platform and a plurality of platform support legs extending downwardly from the support platform, wherein the combined structure of the support platform and the plurality of platform support legs is such that a plurality of lid supports can be intimately stacked for efficient storage. In another embodiment of the present invention, a lid support is provided including a support platform and a serrated edge extending downwardly and outwardly from the support platform. In either of these embodiments, particularly preferred modes of practicing the invention include providing a hole in the support platform to allow the support platform to be employed as a handle by inserting a finger through the hole. The hole also serves to reduce the overall material costs of the lid support.

PREFERRED EMBODIMENT FOR CARRYING OUT THE INVENTION

Figure 1:
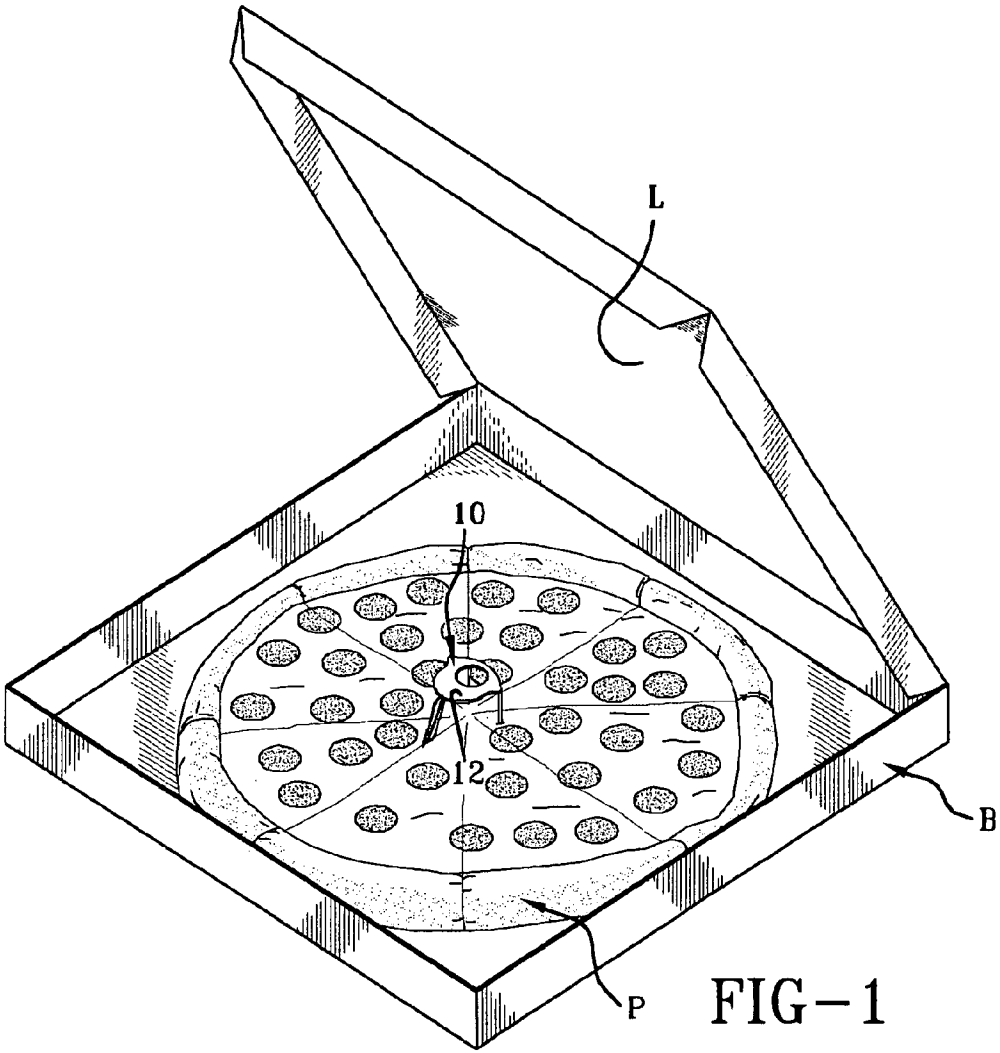
FIG. 1 is a perspective view of the lid support of this invention, shown as employed to prevent the lid of a pizza box from coming into contact with the pizza.

Referring now to FIG. 1, it will be appreciated that the lid supports of this invention, which are generally designated by the numeral 10, will most likely be employed with take-out or delivery pizza P that is served in a pizza box B. It is well known that the lid L of a pizza box B may have a tendency to sag in the middle and contact the pizza, particularly the melted cheese topping. Lid support 10 is placed over the center of the pizza P, such that, when lid L is closed, support platform 12 of lid support 10 provides support for Lid L. With support platform 12 maintained above the melted cheese topping of pizza P, lid L cannot sag and come into contact with the cheese topping, even if multiple boxes B are stacked one upon the other.

Figure 2:
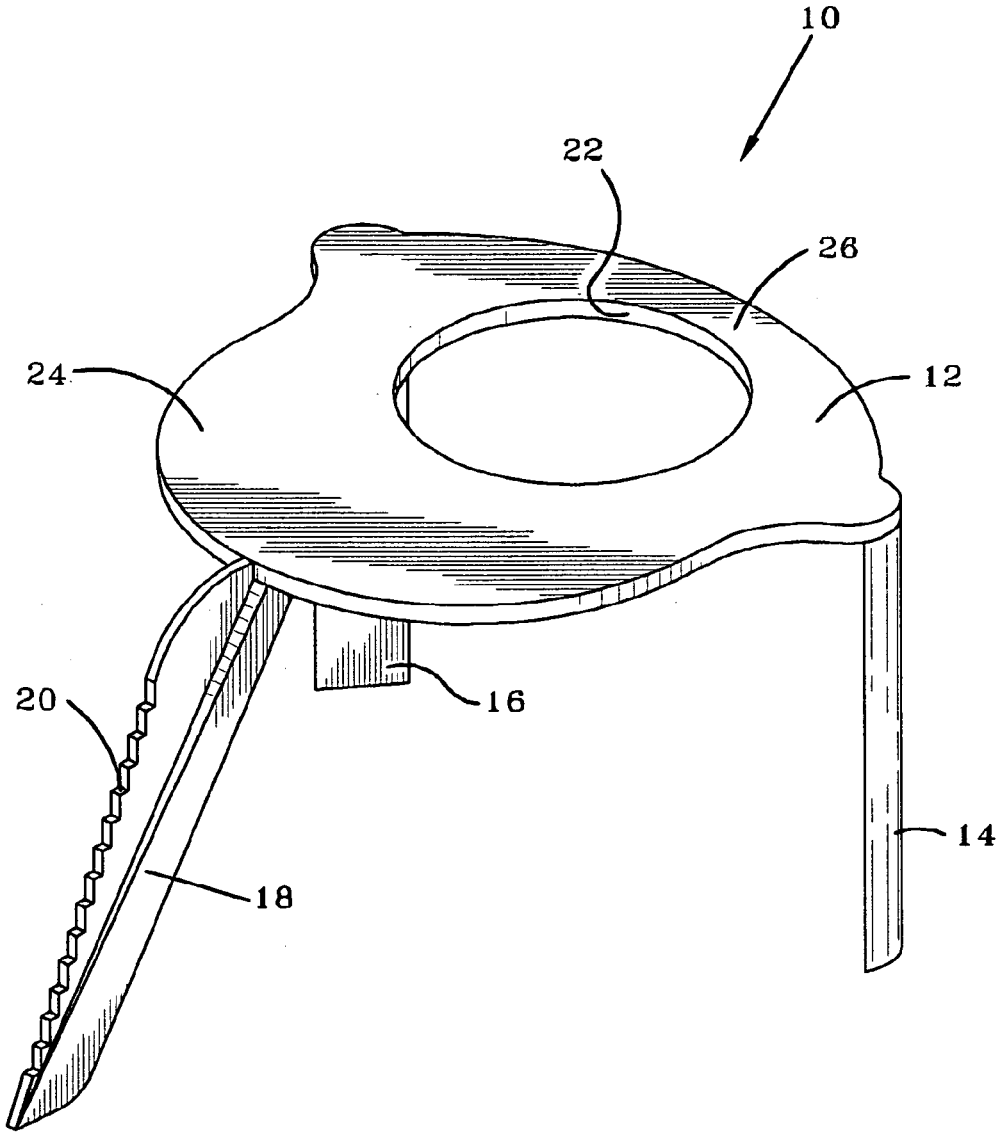
FIG. 2 is a perspective view of the lid support of this invention.

With reference to FIG. 2, it is seen that support platform 12 is maintained in a substantially horizontal position by two support legs 14, 16 and serrated leg 18. Each leg 14, 16 and 18 extends downwardly to preferably the same vertical distance from support platform 12; however, support legs 14, 16 extend downwardly substantially vertically, while serrated leg 18 extends downwardly and outwardly, such that serrated leg 18 is noticeably longer than legs 14, 16. Serrated leg 18 provides a serrated edge 20 at its more external or upwardly facing edge. This edge serves as a cutting utensil, as will be described more fully below. Hole 22 is provided in support platform 12 to facilitate the use of serrated edge 20 as a cutting utensil, and provides the additional benefit of reducing the material cost of lid support 10.

Figure 3:
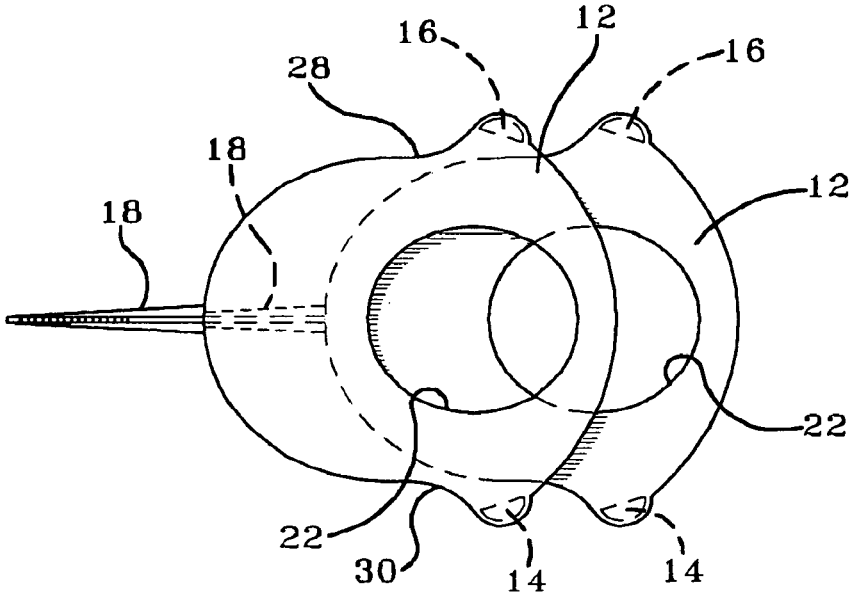
FIG. 3 is a top view showing a support platform configuration that allows multiple lid supports to be intimately stacked.
Figure 4:
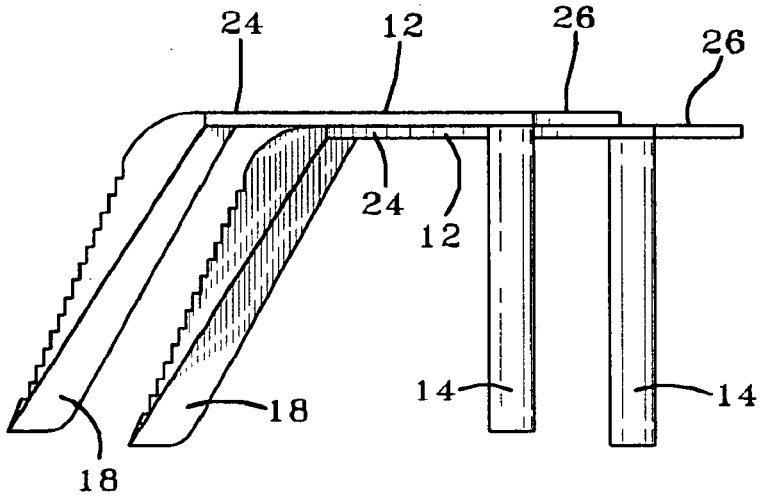
FIG. 4 is a side view showing multiple lid supports that are intimately stacked.

In more preferred embodiments, lid supports 10 of this invention are configured to be intimately stacked for efficient shipping and storage. In the embodiments shown in the figures, particularly in FIGS. 3 and 4, the ability to stack is a function of the configuration of support platform 12 and the manner in which legs 14, 16 and 18 extend therefrom. Generally, lid supports 10 are stackable because support platform 12 is tapered. More particularly, it will be seen that serrated leg 18 extends downwardly and outwardly from front edge 24 of a narrower portion of support platform 12, while support legs 14, 16 extend downwardly proximate a rear edge 26 of a wider portion of support platform 12. In the embodiment shown, the transition from the narrower portion to the wider portion of support platform 12 is defined by taper 28 and taper 30. Support legs 14, 16 are separated by a distance that is large enough to allow the narrow portion to fit therethrough, as shown in phantom in FIG. 3. Thus, multiple lid supports 10 intimately stack with one another, with each successive lid support 10 stacking either on top of or underneath a neighboring support platform 12. Notably, although the narrow and wide portions of support platform 12 are shown having somewhat rounded shapes, the general conditions for allowing multiple lid supports 10 to intimately stack can be provided by other configurations of support platform 12. For example, support platform 12 could be triangular, with serrated leg 18 extending proximate one point and support legs 14, 16 extending proximate the other two points of the triangle.

Figure 5:
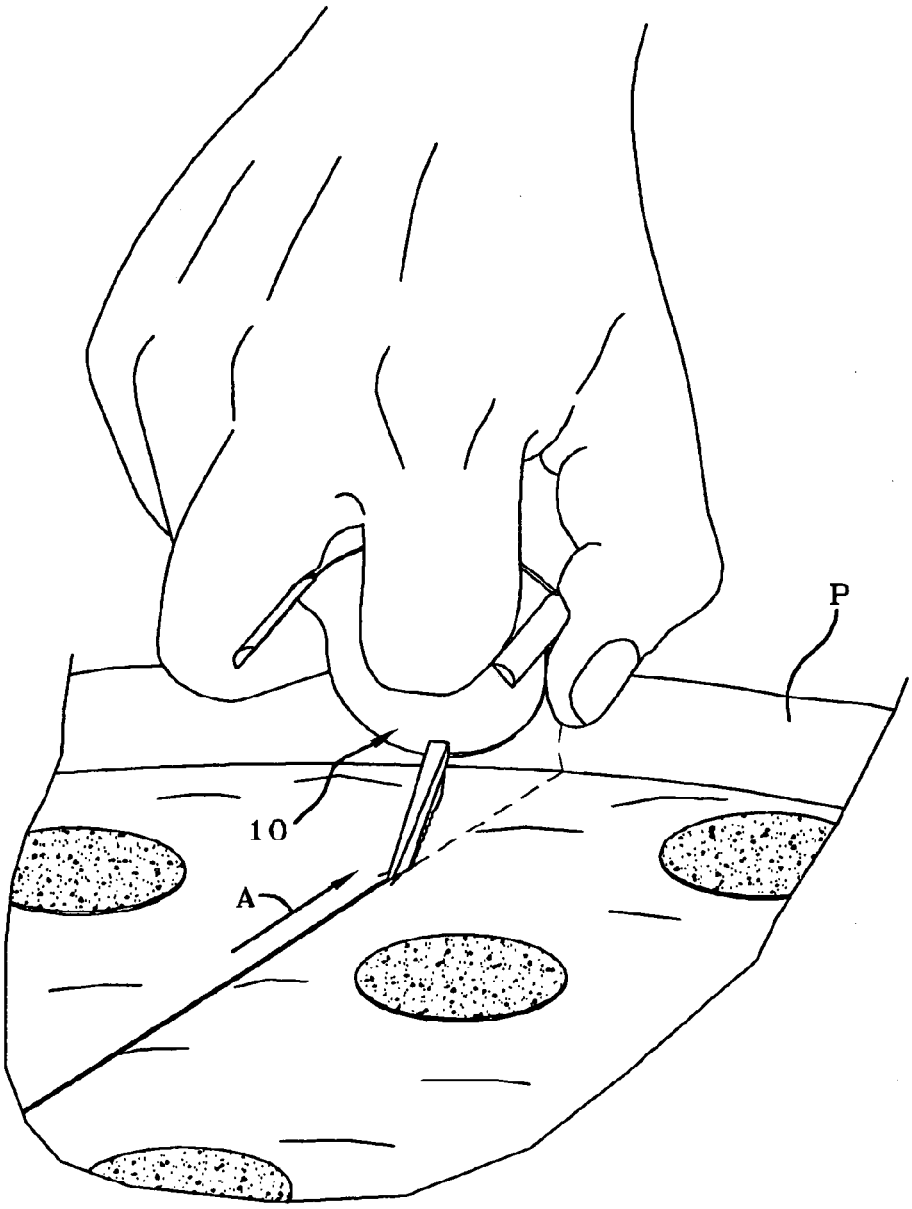
FIG. 5 depicts how the lid support is employed to reinforce the cut-lines made through a pre-cut pizza.

Hole 22 is preferably provided proximate rear edge 26, because it is to serve as a grasping area (or handle) for employing serrated edge 20 as a cutting utensil, and placing hole 22 in this position puts a greater amount of distance between a finger inserted through hole 22 and serrated leg 18. Proper use of lid support 10, particularly for reinforcing the cut-lines of a pre-cut pizza P is depicted in FIG. 5, wherein arrow A represents that serrated edge 20 is drawn across the cut-lines to re-cut the cheese topping that has melted together (represented by the dashed lines in FIG. 5).

Figure 6:
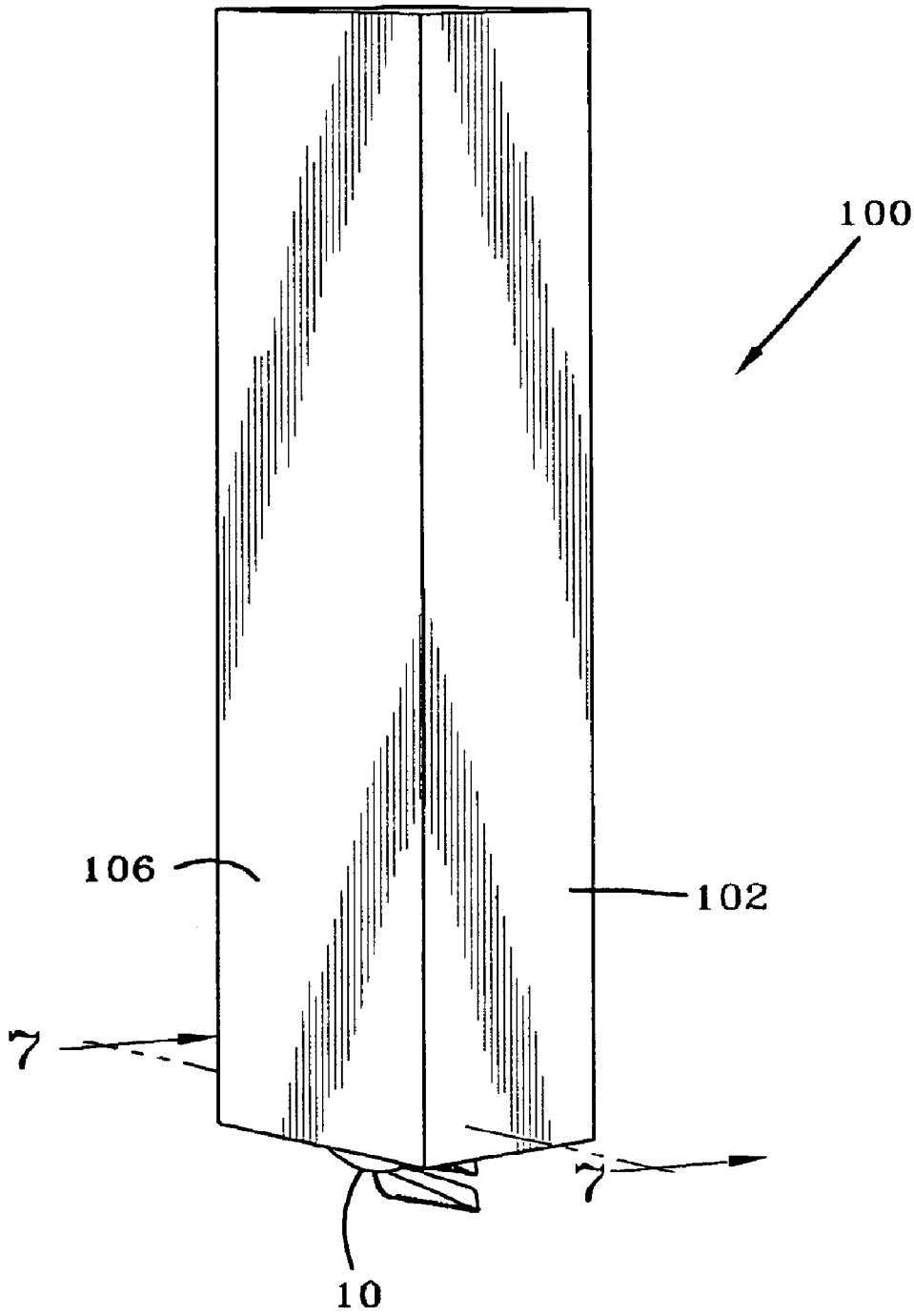
FIG. 6 is a perspective diagram of a lid support dispenser according to this invention.
Figure 7:
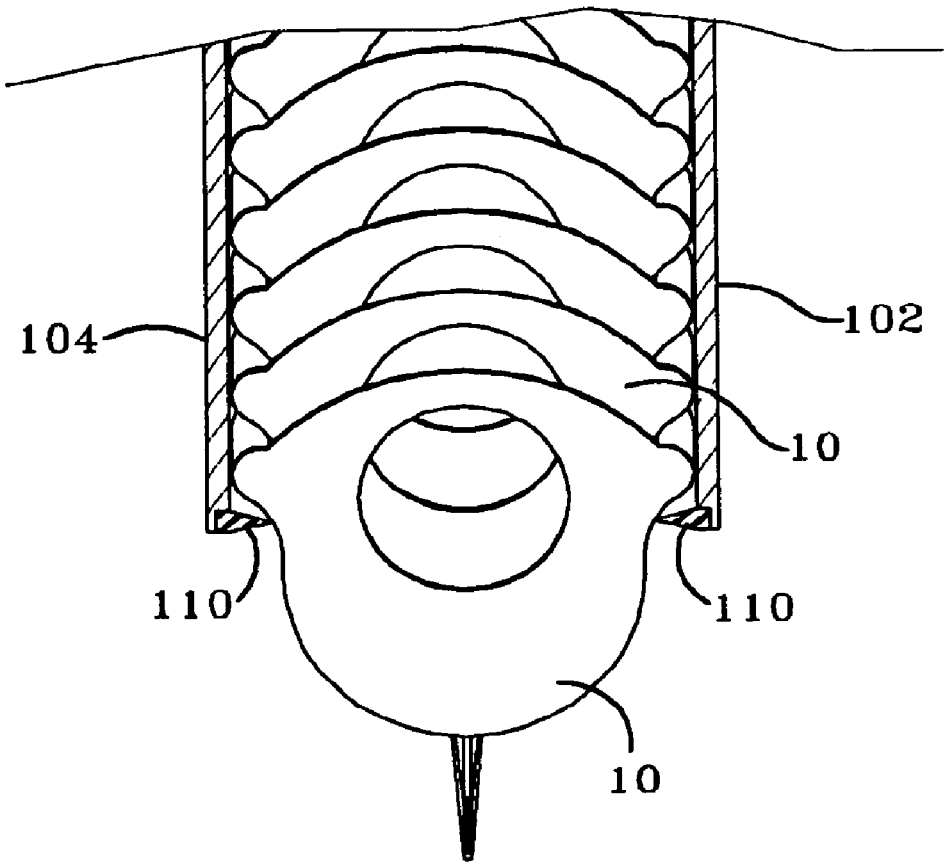
FIG. 7 is a cross-section of the lid support dispenser, taken along the line 7—7 of FIG. 6.

Referring now to FIGS. 6 and 7, an embodiment of a lid support dispenser is designated generally by the numeral 100. Dispenser 100 includes opposed side walls 102, 104 and a front wall 106. A wall opposite wall 106 may also be employed. The walls 102, 104, 106 define a volume for retaining stacked lid supports 10. It should be noted that side walls 102, 104 should be sized with a depth greater than the height of a lid support 10, because, when multiple lid supports 10 are intimately stacked, the height of the stack as a whole is increased. This can be clearly seen in FIG. 4, wherein the lid support on the right extends down further than the lid support to the left, simply as a result of the stacking of those two supports. Inside the walls of dispenser 100, the stacked lid supports 10 are retained by opposed flexible stops 110, which are separated by a distance that allows the narrower portion of support platform 12 to extend between them until the support platform 12 is caught on the wider portion of support platform 12 by flexible stops 110. Pulling downward on the lower-most lid support 10 will cause flexible stops 110 to bend downwardly until the wider portion of support platform 12 is pulled beyond stops 110, and the lower-most lid support is removed from dispenser 100. The remainder of the lid supports are retained in dispenser 100 due to the fact that flexible stops 110 return to the position of FIG. 7 once the wider portion of the lower-most lid support passes beyond stops 110. Notably, it is the stackable aspect of the lid supports taught herein that allows them to be dispensed in a useful manner. The dispenser embodiment shown here is to be non-limiting.

Based upon the foregoing disclosure, it should now be apparent that the use of the lid support described herein will carry out the objects set forth hereinabove. It is, therefore, to be understood that any variations evident fall within the scope of the claimed invention and thus, the selection of specific component elements can be determined without departing from the spirit of the invention herein disclosed and described. In particular, stackable configurations according to the present invention are not necessarily limited to those specifically shown. Moreover, other means for retaining and dispensing multiple lid supports can be substituted for the embodiment depicted herein. Thus, the scope of the invention shall include all modifications and variations that may fall within the scope of the attached claims.

What is claimed is:

1. A lid support comprising:

a support platform tapered to provide a narrower portion and wider portion;

a serrated support leg extending downwardly and outwardly proximate a front edge of said narrower portion; and two opposed support legs extending downwardly proximate a rear edge of said wider portion, wherein the combined structure of said support platform, said serrated support leg and said opposed support legs is such that a plurality of the lid supports are able to be intimately stacked for efficient storage.

2. A lid support comprising:

a tapered support platform providing a narrower portion and a wider portion;

at least two platform support legs extending downwardly from said wider portion of said support platform and supporting said support platform above a support surface; and a serrated support leg extending downwardly and outwardly from said narrower portion of said support platform toward said support surface to provide a cutting edge, wherein said serrated support leg and said at least two platform support legs maintain said support platform in a substantially horizontal plane, and a plurality of the lid supports are able to be intimately stacked for efficient storage.

3. The lid support of claim 2, wherein said support platform includes a grasping member such that the support platform serves as a handle to use said cutting edge as a cutting implement.

4. The lid support of claim 3, wherein said grasping member is a hole in said support platform.

* * * * *